US007173570B1

(12) United States Patent
Wensink et al.

(10) Patent No.: US 7,173,570 B1
(45) Date of Patent: Feb. 6, 2007

(54) CELL PHONE TOWER ANTENNA TILT AND HEADING CONTROL

(76) Inventors: Jan B. Wensink, 20993 Mariposa Rd., Lake Elsinore, CA (US) 92530; Joseph D. Thinn, 813 W. Stevens Ave. #8, Santa Ana, CA (US) 92707

( * ) Notice: Subject to any disclaimer, the term of this patent is extended or adjusted under 35 U.S.C. 154(b) by 249 days.

(21) Appl. No.: 10/889,168

(22) Filed: Jul. 12, 2004

(51) Int. Cl.
*H01Q 3/02* (2006.01)

(52) U.S. Cl. ..... 343/760; 343/890

(58) Field of Classification Search ..... 343/757, 343/763, 765, 890–892, 760, 894; 455/575.7; 342/359

See application file for complete search history.

(56) References Cited

U.S. PATENT DOCUMENTS 4,630,058 A * 12/1986 Brown ..... 342/359
6,239,744 B1 5/2001 Singer et al. ..... 342/359
2003/0160731 A1 8/2003 Wensink ..... 343/892

* cited by examiner

*Primary Examiner*—Micheal C. Wimer
(74) *Attorney, Agent, or Firm*—Kenneth L. Green; Edgar W. Averill, Jr.

(57) ABSTRACT

A cell phone antenna system having simple mechanical tilt and heading adjustments. The antennas are mounted to towers or other structures, and include sensors for measuring antenna tilt and/or heading. A single sensor signal is selected and provided to an interface unit. The interface unit processes the sensor signal and provides sensor information to one or more local or remote processors used to control or monitor the antennas. Antenna control signals generated by the local or remote processors may be provided to the interface unit, and resulting power signals directed to individual actuators on the antennas.

20 Claims, 11 Drawing Sheets

CELL PHONE TOWER ANTENNA TILT AND HEADING CONTROL

BACKGROUND OF THE INVENTION

The present invention relates to control of antenna tilt and heading, and more particularly to an efficient system for adjusting antenna tilt and heading from the base of the antenna tower or from a remote site.

Cell phone systems are rapidly becoming a common mode of communications. The cost of using such systems has dropped rapidly over the past few years, and due to the convenience, many individuals rely solely on cell phones. The resulting substantial increase in use and the competition between service providers has provided significant motivation to maximize the efficiency of cell phone systems.

Cell phone systems involve the cooperation of cell phones operated by individual subscribers within the cells. The cells communicate with the cell phones and relay signals to central facilities which form connections with the desired destination which could be another cell phone or a conventional phone. An important characteristic of cell phone systems is controlling the interaction between cells and cell phones. Each cell generally covers an area on the order of about ten square miles. Signals transmitted between cell phones and cells are limited to low power levels so that the same frequencies may be used in non-adjacent cells. The ability to re-use the same frequencies is a very important characteristic of cell phone systems because the re-use of frequencies allows a much larger number of calls to simultaneously occur within a cell phone system.

A cell generally includes a cell tower (or base station) which includes antennas for transmitting and receiving signals from cell phones. A typical antenna configuration has three sectors aligned 120 degrees apart, thus forming a triangle. Each sector typically has three or four antennas. A single antenna, or a group of antennas defines a beam. The beam has a Maximum Response Axis (MRA) which is generally normal to the face of the antenna, but beams may be steered electronically to point the MRA away from being normal to the face of the antenna. The area covered by a given cell may be adjusted by either pointing (or steering) the beams, or by controlling power levels.

Cell tower antennas are initially adjusted to provide a desired cell coverage. However, over time both the physical orientation of the tower may shift, or the requirements for cell coverage may change due to new cells coming online, or due to usage changes. Further, changes in weather or construction of new structures may affect cell coverage. Traditionally, the most common antenna adjustment is adjusting down-tilt. Originally, adjusting down-tilt required a technician to climb the tower and manually adjust antenna mounting hardware to mechanically change the antenna tilt. Such manual adjustment was time consuming, costly, possibly dangerous, and required system downtime.

U.S. Pat. No. 6,239,744 for "Remote Tilt Antenna System," describes a cell phone antenna system having an electronic tilt, and with antenna controllers associated with each antenna. Although the problems associated with manual tilt adjustment are addressed by the antenna system described in the '744 patent, the use of electronic tilt adjustment alters the shape of the beams. Because the antennas are designed to optimize beam shape for a non-steered beam, it may be assumed that electronic beam steering results in a less than optimal beam shape. For example, the main lobe of the beam may broaden, and/or side lobes may increase in width and/or amplitude. Further, the requirement for individual controllers for each antenna results in substantial cost and complexity, and the '744 patent does not address beam heading (i.e., azimuth).

BRIEF SUMMARY OF THE INVENTION

The present invention addresses the above and other needs by providing a cell phone antenna system having simple mechanical tilt and heading adjustments. The antennas are mounted to towers or other structures, and include sensors for measuring antenna tilt and/or heading. A single sensor signal is selected and provided to an interface unit. The interface unit processes the sensor signal and provides sensor information to one or more local or remote processors used to control or monitor the antennas. Antenna control signals generated by the local or remote controllers may be provided to the interface unit, and resulting power signals directed to individual actuators on the antennas In accordance with one aspect of the invention, there is provided a cell phone antenna system comprising antenna mounts, at least two antennas mounted to a structure by the antenna mounts, at least two sensors adapted to measure an attitude of the antennas, and at least two actuators adapted to adjust the attitude of the antennas. The system further includes an interface unit adapted to communicate with at least one controller, generate an antenna address, and generate actuator commands. A decoder is adapted to receive the antenna address from the interface unit and generate a relay signal, and one of at least two sensor relays is adapted to receive the relay signal from the decoder and to communicatingly connect a corresponding one of the at least two sensors to the interface unit. One of at least two actuator relays is adapted to receive the relay signal from the decoder and to provide power to a corresponding one of the at least two actuators to adjust the attitude of the corresponding antenna.

In accordance with another aspect of the present invention, there is provided a method for adjusting the attitude of cell phone antennas. The method comprises receiving an antenna ID at an interface unit, converting the antenna ID to an antenna address, and sending the antenna address from the interface unit to a decoder. The decoder decodes the antenna address and sends an ON Signal to a sensor relay corresponding to the antenna address. The sensor relay receiving the ON Signal is switched on, and passes a sensor signal indicative of an antenna attitude through the switched-on sensor relay to the interface unit. The interface unit sends a message including the sensor signal to a controller.

If a change in antenna attitude is desired, the controller may send an actuator command to the interface unit. The decoder sends an ON Signal to an actuator relay corresponding the antenna address, thereby switching on the actuator relay receiving the ON Signal. Power is provided through the switched-on actuator relay to change the attitude of the antenna corresponding to the antenna ID.

BRIEF DESCRIPTION OF THE SEVERAL VIEWS OF THE DRAWING

The above and other aspects, features and advantages of the present invention will be more apparent from the following more particular description thereof, presented in conjunction with the following drawings wherein.

Corresponding reference characters indicate corresponding components throughout the several views of the drawings.

DETAILED DESCRIPTION OF THE INVENTION

The following description is of the best mode presently contemplated for carrying out the invention. This description is not to be taken in a limiting sense, but is made merely for the purpose of describing one or more preferred embodiments of the invention. The scope of the invention should be determined with reference to the claims.

Figure 1:
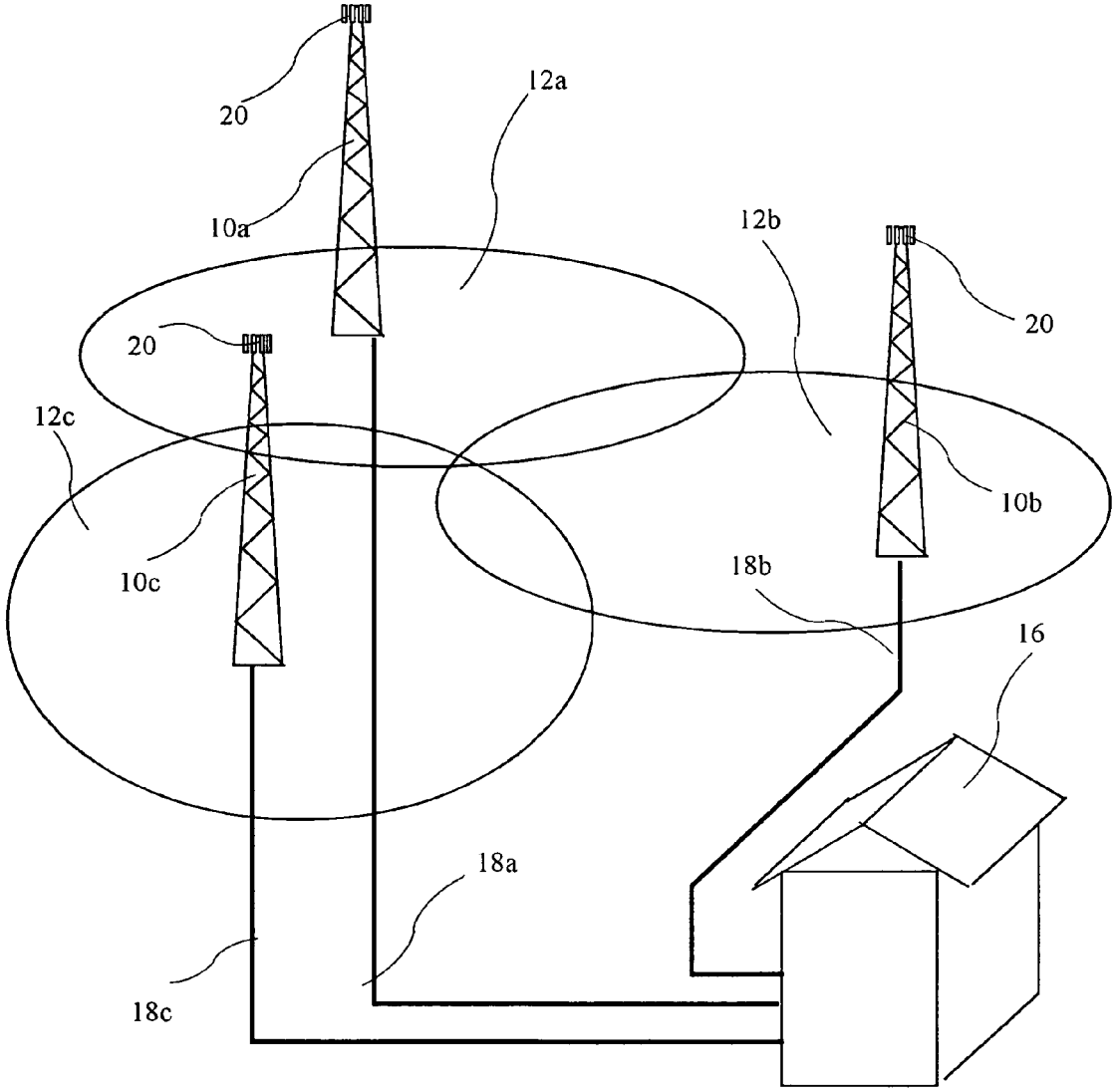
FIG. 1 is a cell phone system having cooperating cells and a switching center.

A cell phone system having cooperating cells 12*a*–12*c* and a switching center 16 is shown in FIG. 1. Each cell 12*a*–12*c* includes a tower 10*a*–10*c*, and each tower includes an antenna array 20. The towers 10*a*–10*c* are connected by communications lines 18*a*–18*c* to the switching center 16. The switching center 16 monitors the activity in cells 12*a*–12*c*, and switches individual cell phones between the cells 12*a*–12*c* as needed to maintain contact between the cell phones and the cells 12*a*–12*c*, and to balance loads between cells 12*a*–12*c*.

Figure 2:
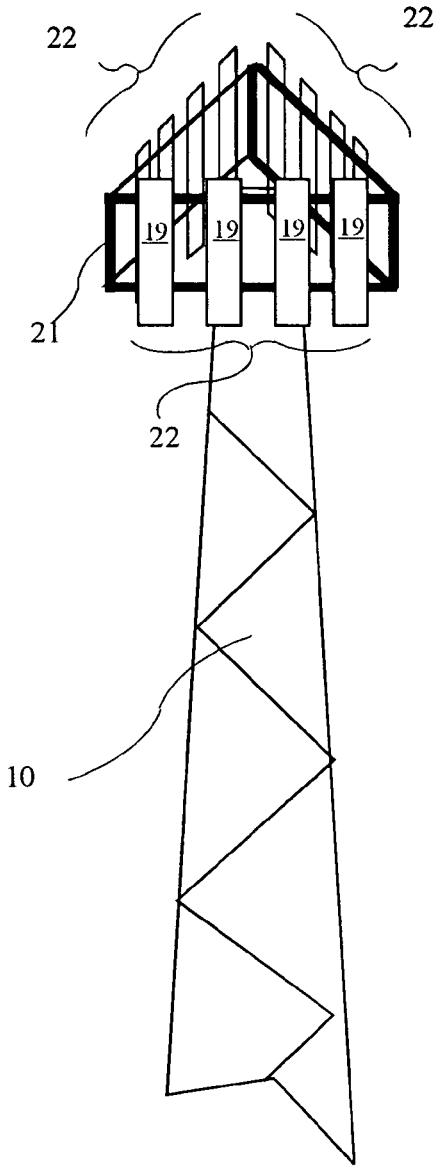
FIG. 2 shows antenna sectors mounted to a tower.
Figure 3:
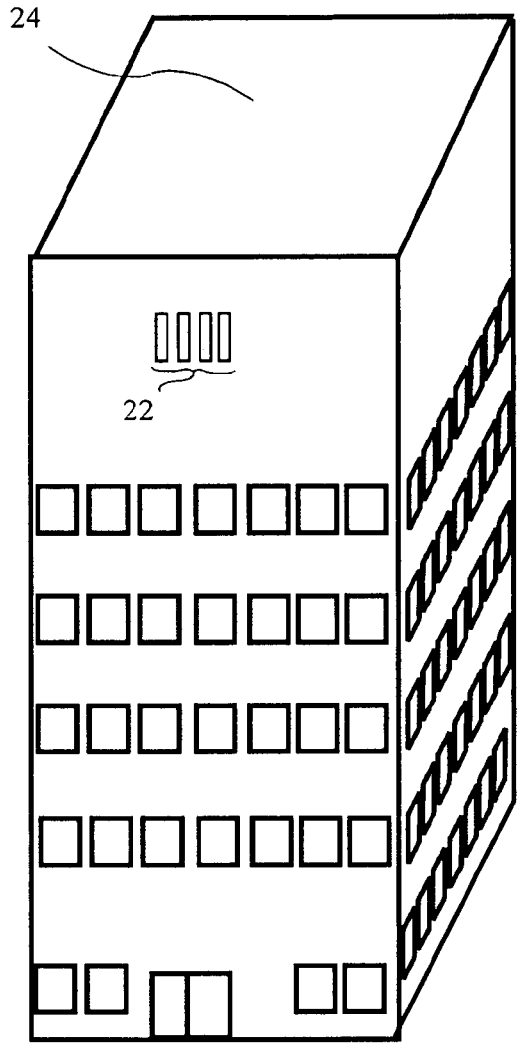
FIG. 3 shows the antenna sectors mounted to a building.

Three antenna sectors 22 arranged in a triangle are shown mounted to a tower 10 using antenna mounts 21 in FIG. 2. Each sector 22 includes a multiplicity of antennas 19, and preferably includes between one and five antennas 19 and more preferably between three and four antennas 19. The sectors 22 may alternatively be mounted to a building 24 as shown in FIG. 3, or to other existing structures. Such antenna mounts are described in detail by U.S. patent application Ser. No. 10/080,843 (U.S. Publication No. 2003/0160731) for "System for Remotely Adjusting Antennas," owned by the inventor of the present invention. The '731 publication is herein incorporated by reference.

In one embodiment of the present invention, the attitude (i.e., tilt and/or heading) of the antennas 19 and/or sectors 22 is measured (or sensed) with respect to the tower 10, building 24, or any substantially fixed reference, wherein a substantially fixed reference is any structure which is fixed to the Earth, and other than expansion, settling, sagging, and the like, does not move. Such sensing may be by resolvers, encoders, transducer, or the like, which measure the relative attitude of the antenna or sector relative to the reference directly, or my measuring an attitude relative to some member of the antenna mounts 21. An antenna tilt and/or heading control and/or monitoring system including any means for measuring an attitude of an antenna is intended to come within the scope of the present invention.

Figure 4A:
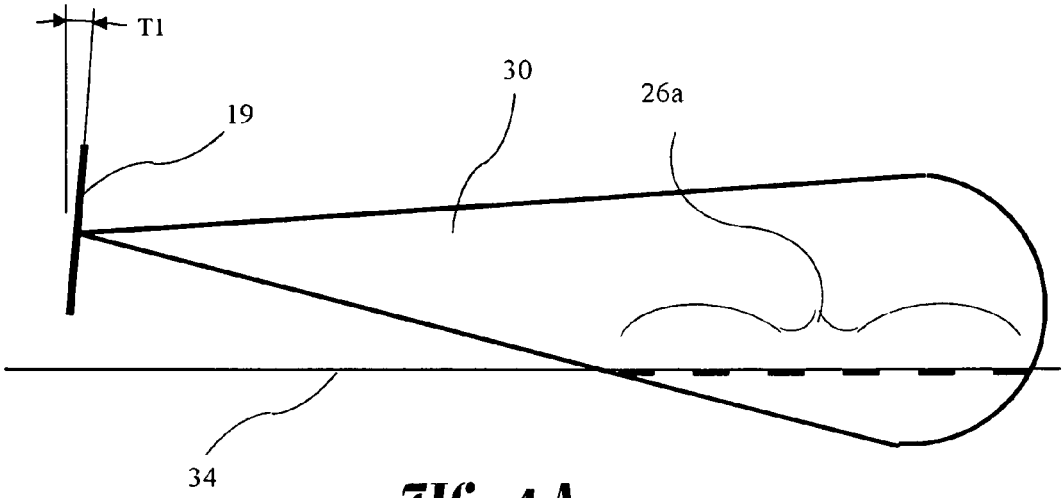
FIG. 4A depicts an antenna having a first tilt angle.
Figure 4B:
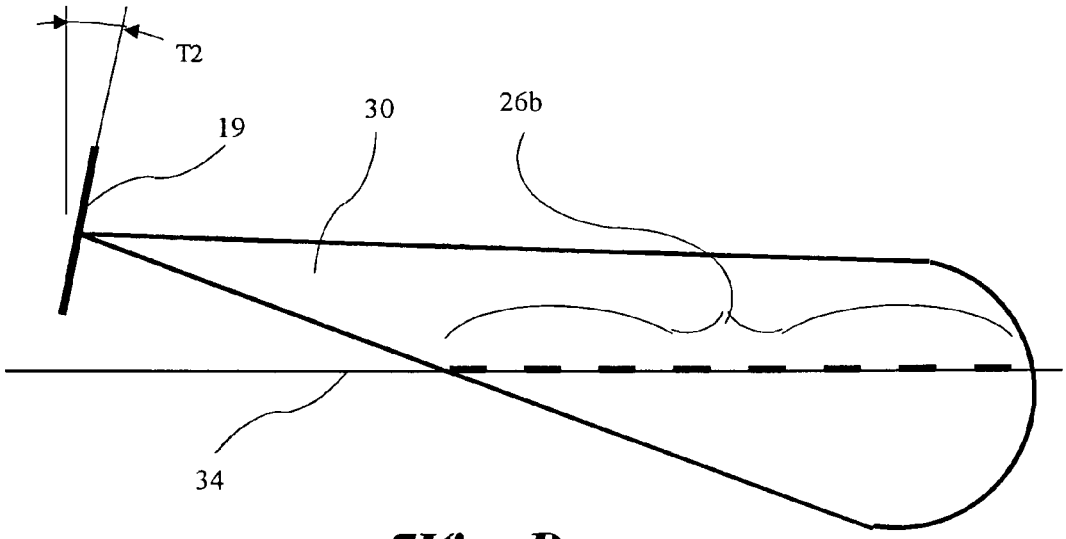
FIG. 4B depicts the antenna having a second tilt angle.

The antenna 19 having a tilt angle T1 is shown in FIG. 4A. The tilt angle is adjustable to control cell 12*a*–12*c* coverage. A side view of the projection of a vertical beam cross-section 30 on the ground 34 is indicated by segment 26*a*. A side view of the antenna 19 having a second tilt angle T2 is shown in FIG. 4B, with the resulting second segment 26*b*.

Figure 5A:
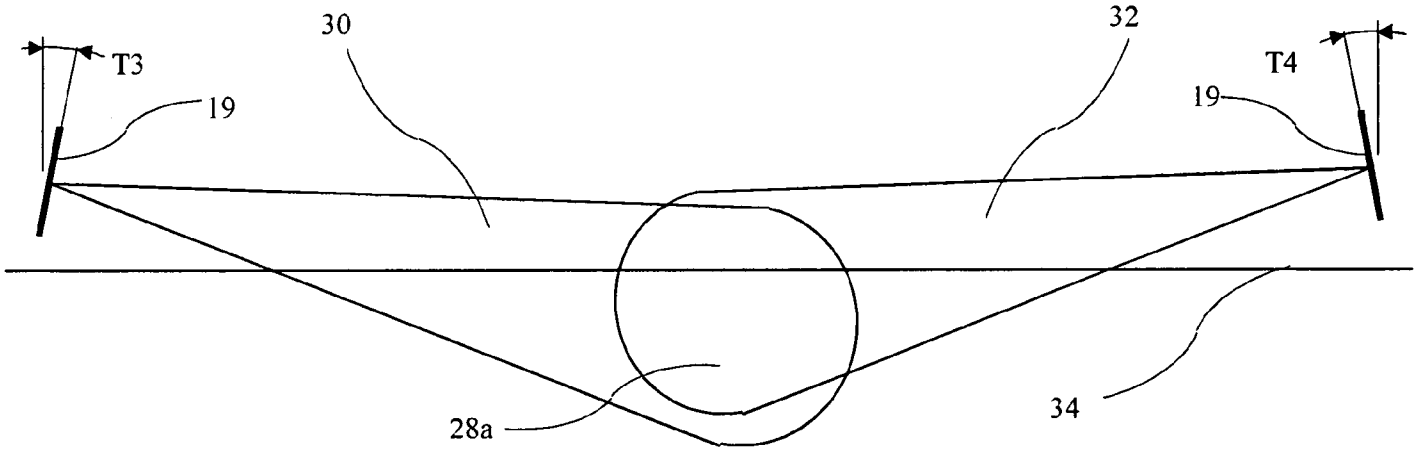
FIG. 5A depicts side view of the overlap of two cooperating cells.
Figure 5B:
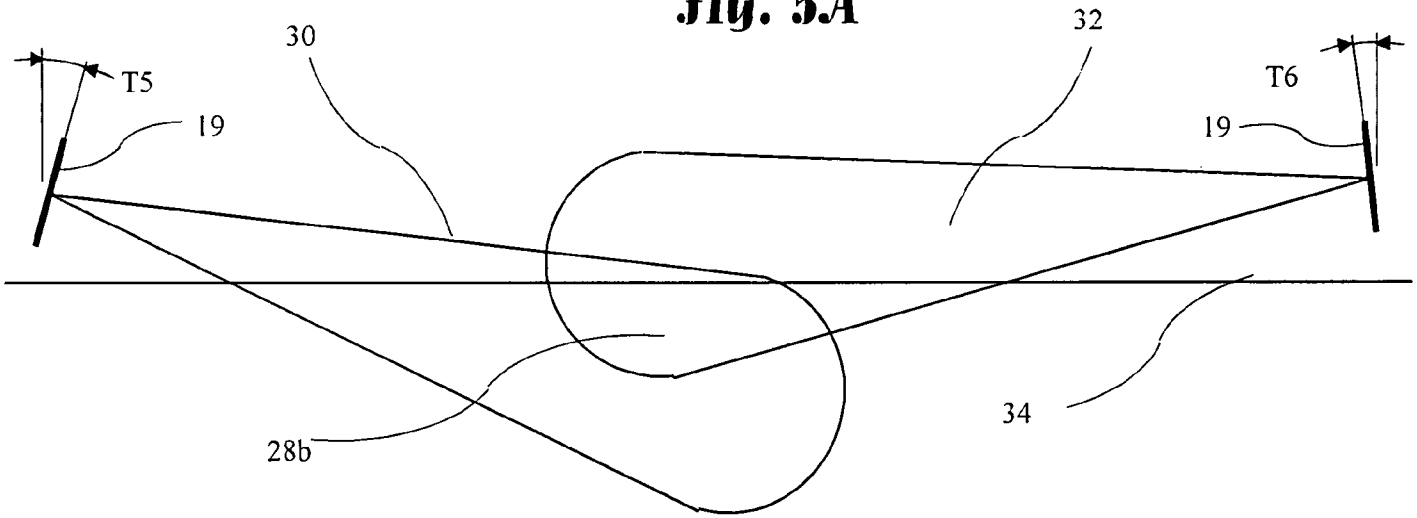
FIG. 5B depicts a change in overlap of cooperating cells when the tilt angles of the antennas are changed.

A side view of the first overlap 28*a* of two cooperating cells 12*a*–12*c* (see FIG. 1) is shown in FIG. 5A. The antennas 19 are tilted at angles T3 and T4. A second side view with the antennas 19 tilted to angles T5 and T6 resulting in second overlap 28*b* is shown in FIG. 5B. Comparing FIGS. 5A and 5B depicts the affect of antenna 19 tilt changes. Such changes may be made to adapt to changes of weather, local structures, shifts in tower 10 (see FIG. 2) structure, or call levels.

Figure 6:
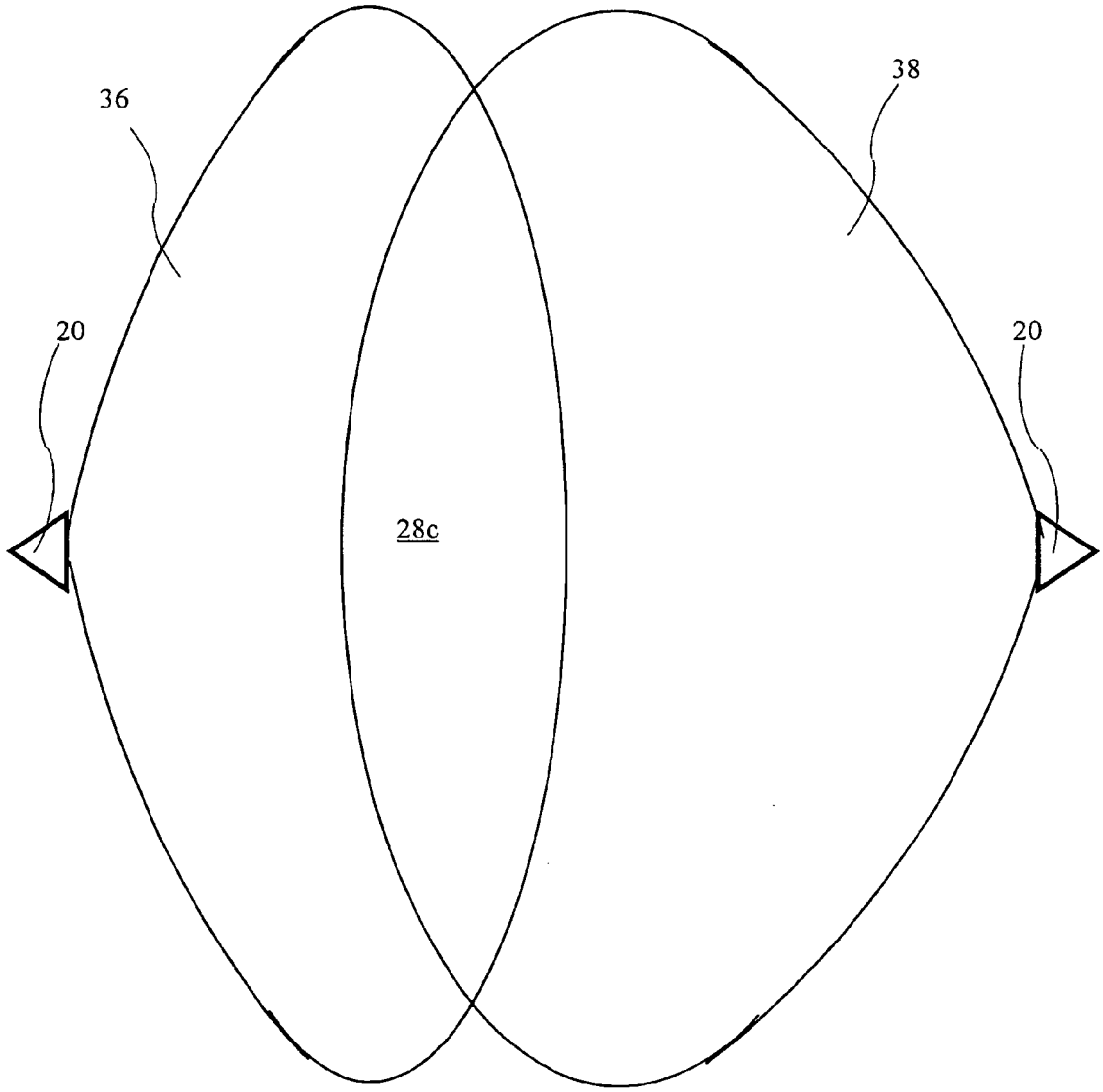
FIG. 6 shows top view of the overlap of cooperating cells.
Figure 7:
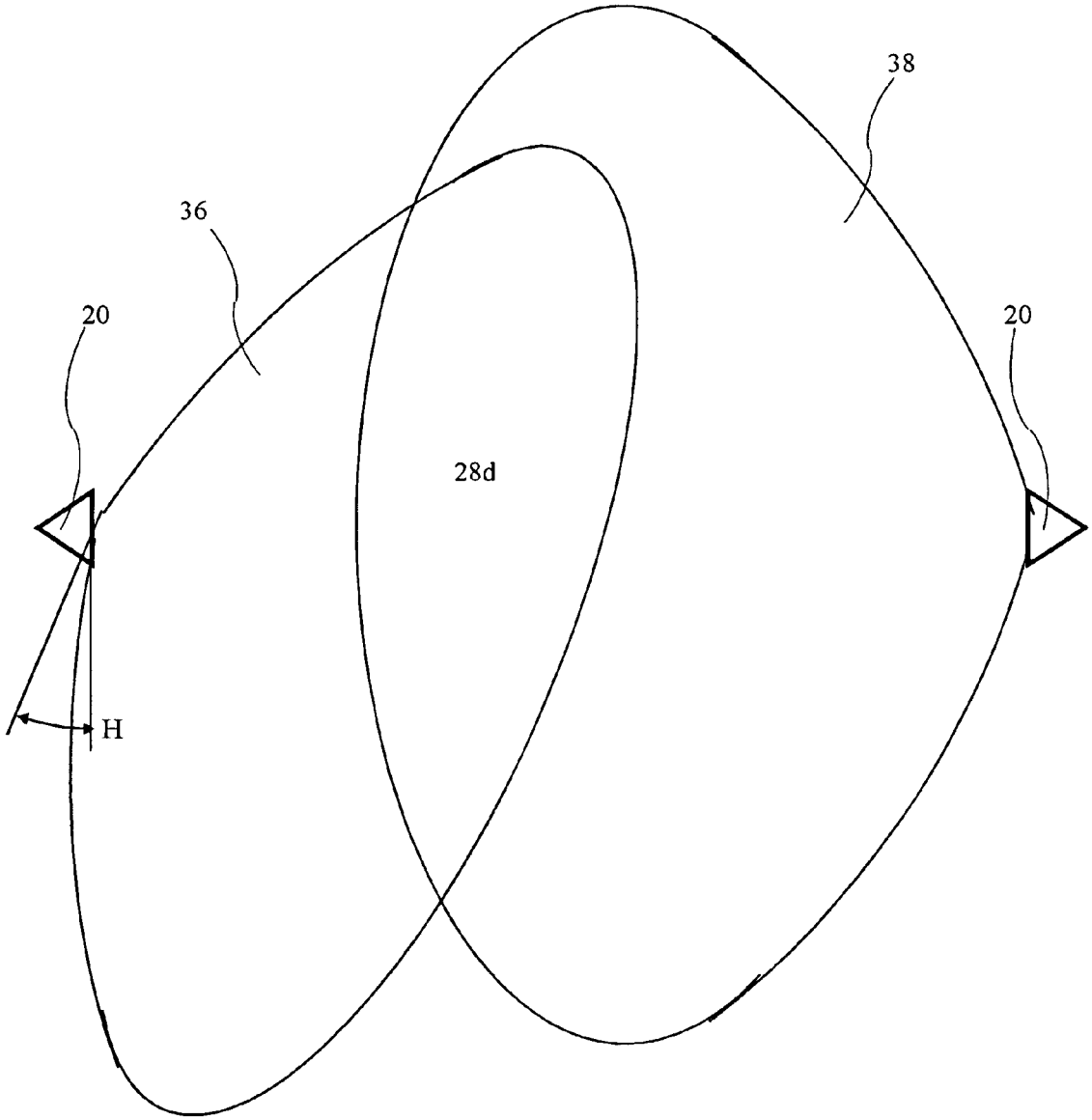
FIG. 7 shows a change in the top view of the overlap between cooperating cells when the heading angles of the antennas are changed.

A top view of a third overlap 28*c* of cooperating cells 12*a*–12*c* is shown in FIG. 6. Horizontal beam cross-section 36 is generally much greater than the vertical beam cross-section 30 (see FIGS. 5A, 5B). Optimization of cell 12*a*–12*c* cooperation may motivate steering a sector 22 (see FIG. 2) of the antenna array 20 in heading to alter the overlap between cooperating cells 12*a*–12*c*. For example, one sector 22 might be steered to a heading H to shift the horizontal beam cross-section 36, resulting in fourth overlap 28*d*.

Figure 8:
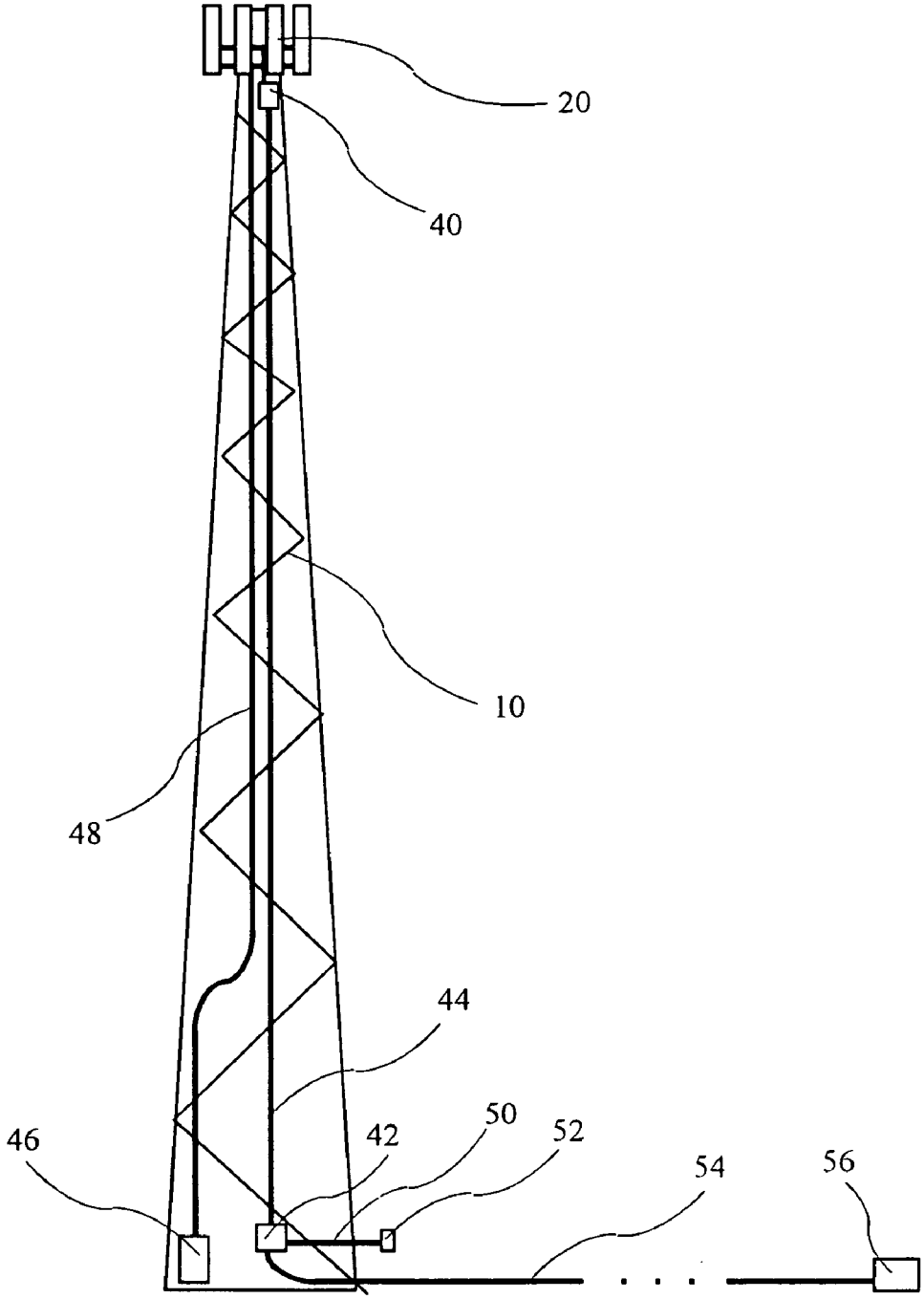
FIG. 8 is a cell system including antenna tilt and heading control according to the present invention.

A cell system including antenna tilt and heading control according to the present invention is shown in FIG. 8. The cell system includes interface electronics 42 at the base of the tower 10, a local interface 50 which may be connected to a local controller 52, and a remote interface 54 which may be connected to a remote controller 56. A preferred remote interface 54 is a fiber optics interface including a digital signal to fiber optics converter The local interface 50 is preferably a USB connector, 9 pin connector, a 10/100 cable, or a DB 25 connector. The local interface may be used to connect to a laptop computer, a palm pilot, or a special-purpose device having specific functionality for antenna adjustment. The remote interface is preferably a 10/100 cable connected to a remote site, and more preferably connected to a computer at the switching center 16. A data cable connects the interface electronics 42 to tower electronics 40. The tower electronics 40 may be housed in a single cabinet, or distributed into separate cabinets. A power source 46 at the base of the tower 10 is connected to the antenna array 20 by a power cable 48.

Figure 9:
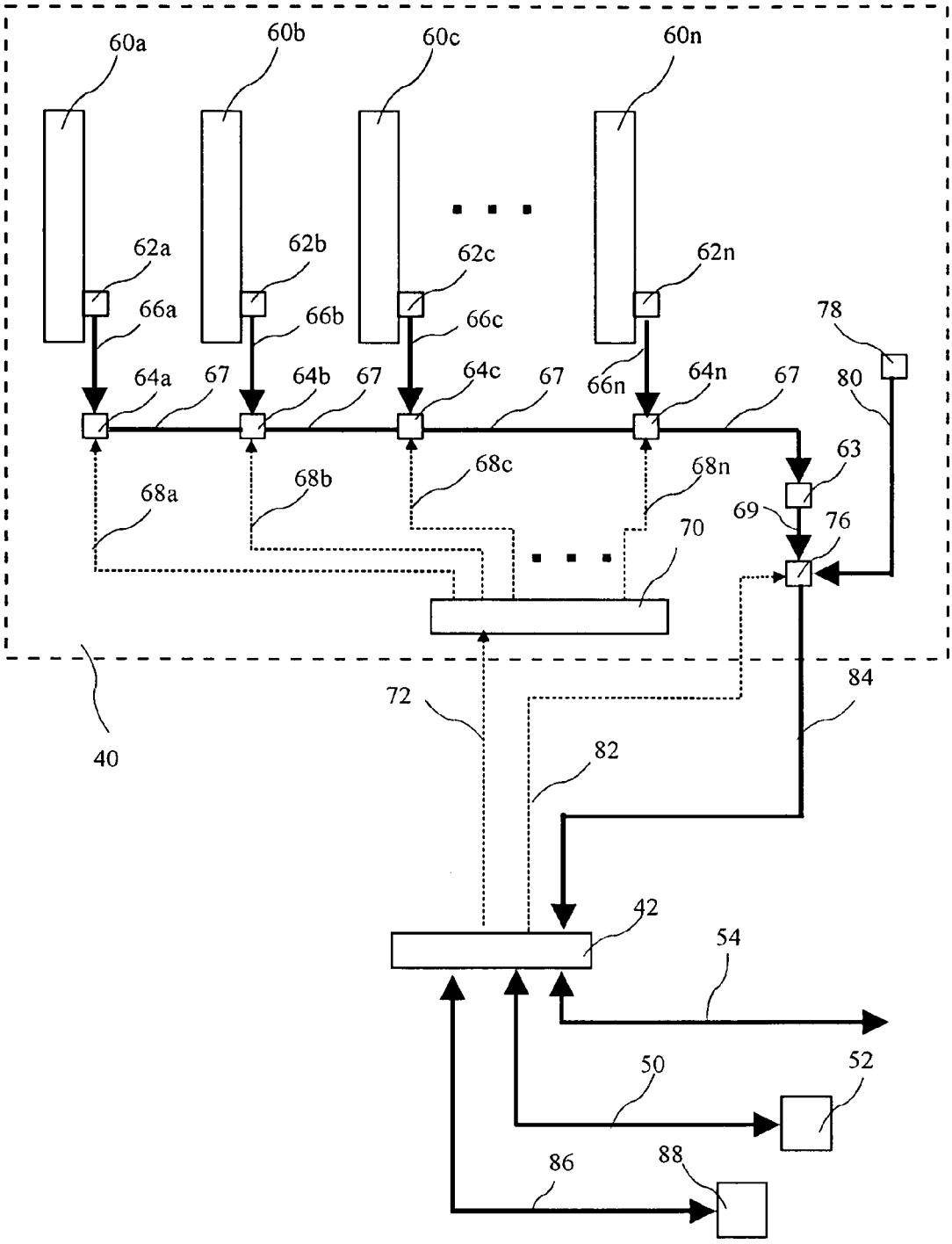
FIG. 9 is a diagram of an antenna attitude monitoring system according to the present invention.

A diagram of an antenna attitude monitoring system according to the present invention is shown in FIG. 9. The interface electronics 42 are communicatingly connected to the remote interface 54, the local interface 50 connected to a local controller 52, and data cable 86 connected to a fiber optics converter 88. An address cable 72 carries an antenna address from the interface electronics to a decoder 70, which decoder is preferably a 1 of 16 decoder. The decoder 70 decodes the antenna address and provides an ON Signal to one of a group of tilt sensor relays 64*a*–64*n* corresponding to the antenna address over one of a group of tilt relay control cables 68*a*–68*n* corresponding to the antenna address. Tilt sensors 62*a*–62*n* are mechanically connected to antennas 60*a*–60*n* respectively and provide tilt data to the tilt sensor relays 64*a*–64*n*. The tilt sensors 62*a*–62*n* are preferably levels which measure antenna tilt by sensing gravity, or are resolvers (e.g., encoders, transducers, or the like) which measure the tilt of the antennas 60*a*–60*n* relative to a fixed point of reference, for example, the antenna mounts 21 (see FIG. 2). The tilt sensor data is carried by tilt sensor cable 67 to a tilt sensor processor 63. The tilt sensor processor preferably converts raw tilt sensor data to serial stream data and is more preferably an EZ-TILT-5000 manufactured by Advanced Orientation Systems, Inc in Linden, N.J.

Continuing with FIG. 9, a heading sensor (or compass) 78 senses the heading (or azimuth) of the antennas. The heading sensor 78 preferably measures the heading of the sector 22 (see FIG. 2) of antennas 60*a*–60*n*, but may also measure the heading of individual antennas 60*a*–60*n*, and is preferably an electrical compass which measures the antenna heading with respect to magnetic north, or is a resolver which measures the antenna heading with respect to the antenna mounts, to the structure the antenna is mounted to, or any other fixed point of reference. Heading sensor data is carried by a heading sensor cable 80 from the heading sensor 78 to a heading sensor relay 76 which is preferably a selector relay, which heading sensor relay 76 is also connected to the tilt sensor processor 63 by a processed data cable 69 and receives the processed tilt sensor data. The heading sensor relay receives a heading sensor relay control signal from the interface electronics 42 through a heading relay control cable 82. The signal (tilt sensor or heading sensor) selected by the heading sensor relay control signal is provided to the interface electronics 42 by a sensor data cable 84. The interface electronics 42 provide the selected sensor signal to either a local or remote monitor or controller.

Figure 10:
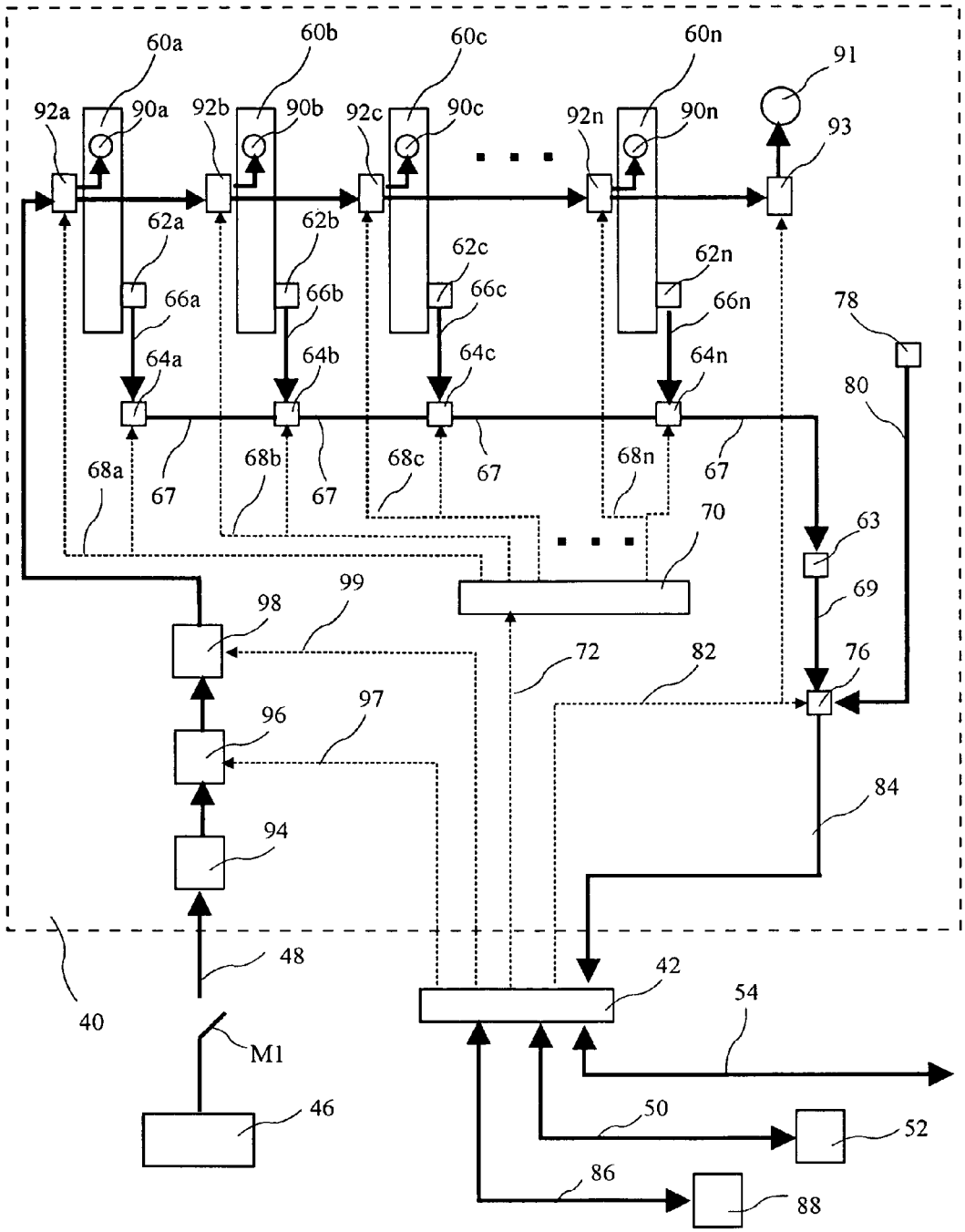
FIG. 10 is a diagram of an antenna attitude monitoring and adjustment system according to the present invention.
Figure 11:
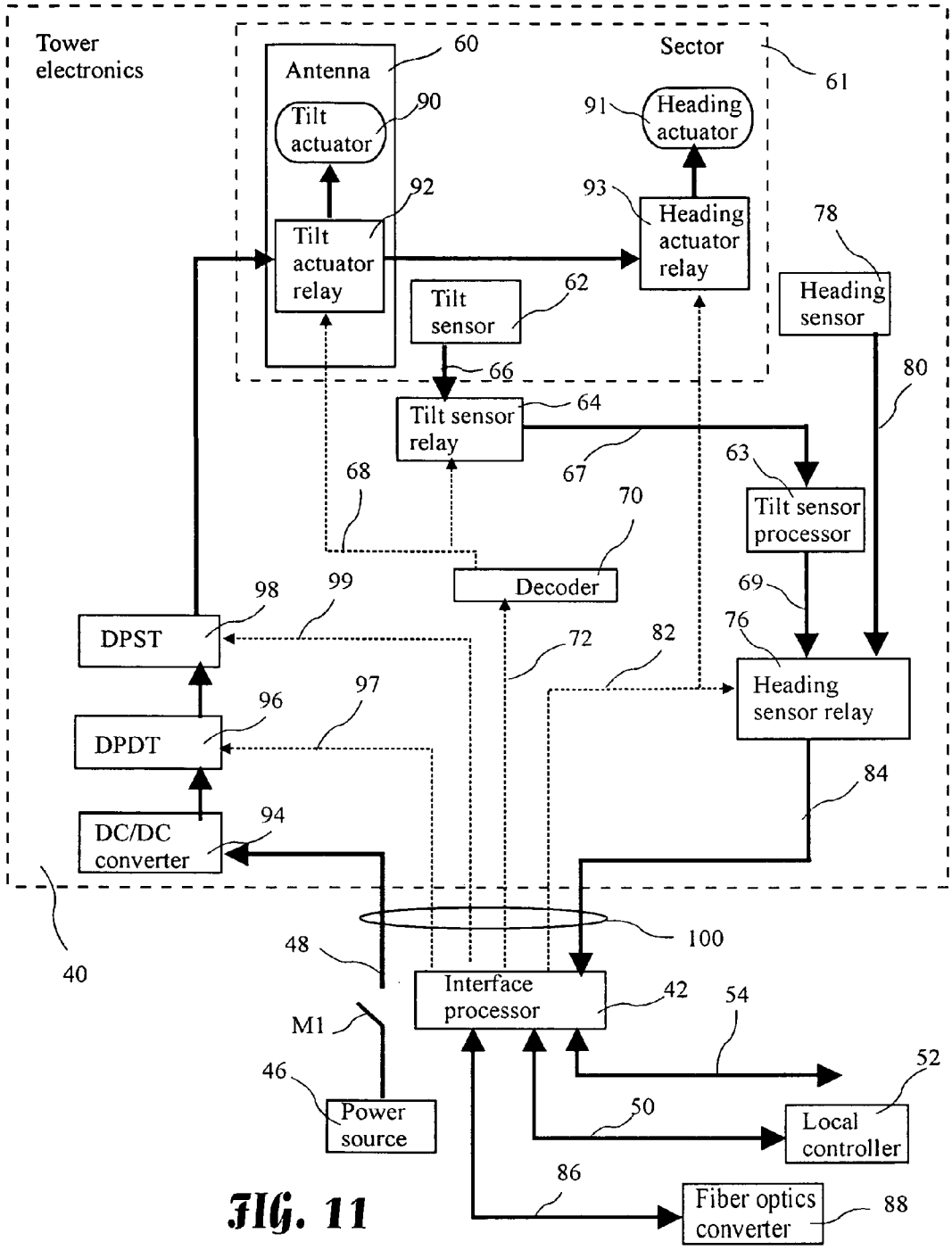
FIG. 11 is a detailed version of the antenna attitude monitoring and adjustment system according to the present invention.

The monitoring system described in FIG. 9 may be expanded into an antenna attitude monitoring and adjustment system described in FIGS. 10 and 11. The descriptions in FIGS. 10 and 11 are of the same embodiment and provide slightly different formats to facilitate understanding of the present invention. In addition to the monitoring apparatus described in FIG. 9, the monitoring of an adjustment system includes tilt actuators 90 and a heading actuator 91. The tilt actuators 90 may be mechanical or linear actuators incorporated into the antenna mounts 21 (see FIG. 2), which actuators mechanically tilt the body of the antennas 90*a*–90*n* to adjust the cell coverage. Such mechanical actuators are described in detail by U.S. patent application Ser. No. 10/080,843 for "System for Remotely Adjusting Antennas," owned by the inventor of the present invention. The '731 publication is incorporated by reference above. The tilt actuators 90*a*–90*n* may further be actuator elements of an electronic tilt system such as the Teletilt™ system made by Andrews Corporation, Orland Park, Ill. and the tilt sensors 62*a*–62*n* may be a sliding, linear, or rotary potentiometer or linear encoder or other position detecting transducer used to measure the position of an electronic tilt mechanism.

Continuing with FIGS. 10 and 11, control of the tilt actuators 90*a*–90*n* parallels selection on the tilt sensors 66*a*–66*n* described above. The same tilt relay control cables 68*a*–68*n* which carry the On Signal to the tilt sensor relays 64*a*–64*n* also carry the ON Signal to tilt actuator relays 92*a*–92*n*. When one of the tilt actuator relays 92*a* receives the On Signal, the switched-on relay passes a power signal to the corresponding actuator, resulting in a change in antenna tilt. The power signal originates in the power source 46, and passes through a manual switch Ml, a DC/DC converter 94, and Double Pole Double Throw (DPDT) relay 96 and through a Double Pole Single Throw (DPST) relay 98, all serially connected between the power source 46 and the tilt relays 92*a*–92*n*. The DC/DC converter is provided to provide a constant and predictable voltage to the tilt actuators 90*a*–90*n*. The DPDT relay 96 is controlled by a directional signal carried by the DPDT cable 97 from the interface electronics 42 to the DPDT relay 96. The directional signal is based on commands from the controller, and determines which direction the actuator moves the antenna. The DPST relay 98 is controlled by an OFF/ON signal carried by the DPST cable 99 from the interface electronics 42 to the DPST relay 98. The OFF/ON signal is based on commands from the controller, and determines when the actuator moves the antenna. A preferred actuator control algorithm for use with the present invention is described in U.S. patent application Ser. No. 10/080,843 for "System for Remotely Adjusting Antennas," owned by the inventor of the present invention. The control algorithm of the '731 publication is preferably implemented in the local controller or the remote controller. The '731 publication is incorporated above by reference. Preferably, the interface electronics 42 monitors the actuator commands received from the controllers 52, 54, and non-zero actuator commands will be zeroed after a fixed time to ensure control system stability.

A heading actuator 91 receives the power signal through a heading actuator relay 93, which heading actuator relay 93 responds to the same On Signal provided by the heading relay control cable 82 to the heading sensor relay 76. Preferably, the antennas 90*a*–90*n* in the sector 22 (see FIG. 2) are steered to a single heading, but a separate heading sensor and heading actuator may be provided for each antenna 90*a*–90*n* in the same manner as separate tilt sensors and tilt actuators are provided for each antenna in FIGS. 10 and 11. While cables 48, 72, 82, 84, and 99 are shown as separate cables, preferably, a single multi function cable 100 includes cables 48, 72, 82, 84, and 99 into a single cable.

Figure 12:
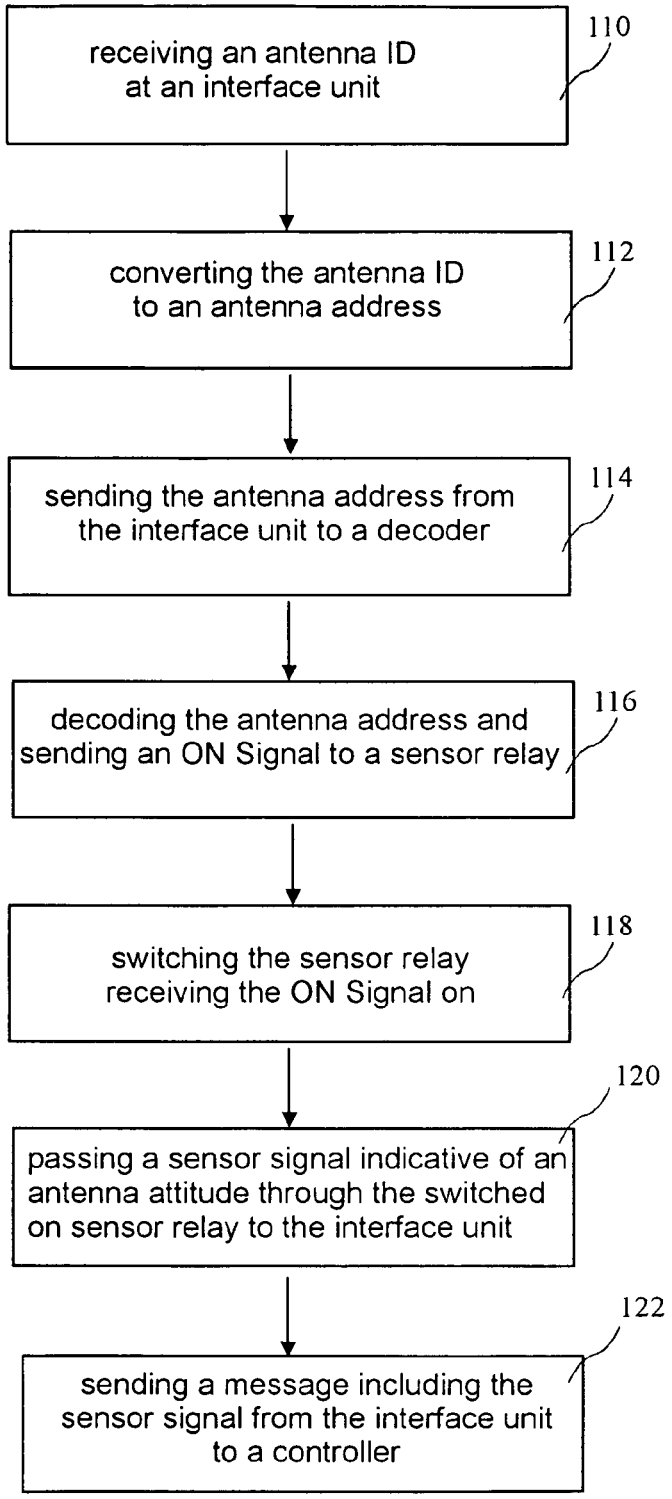
FIG. 12 describes a method of adjusting the attitude of a cell antenna.

A method for adjusting the attitude of cell phone antennas is described in FIG. 12. The method includes the steps of receiving an antenna ID at an interface unit at step 110, and converting the antenna ID to an antenna address at step 112. The antenna address is sent from the interface unit to a decoder at step 114, and the antenna address is decoded at step 116. An ON Signal is sent to a sensor relay corresponding to the antenna address at step 118, and the sensor relay receiving the ON Signal is switched on at step 120. A sensor signal indicative of an antenna attitude is passed through the switched-on sensor relay to the interface unit, and a message including the sensor signal is sent from the interface unit to a controller at step 122. The method may further include receiving an actuator command at the interface unit, wherein the actuator command is from the controller. An ON Signal is sent to an actuator relay corresponding to the second antenna address, switching on the actuator relay receiving the ON Signal. Power is provided through the switched-on actuator relay to change the attitude of the antenna corresponding to the second antenna ID.

While the invention herein disclosed has been described by means of specific embodiments and applications thereof, numerous modifications and variations could be made thereto by those skilled in the art without departing from the scope of the invention set forth in the claims.

We claim:

1. A cell phone antenna system comprising:

antenna mounts;

at least one antenna mounted to a structure by the antenna mounts;

at least one sensor adapted to measure an attitude of the antenna;

at least one actuator adapted to adjust the attitude of the antenna;

an interface unit adapted to:

communicate with at least one controller;

generate an antenna address;

generate actuator commands; and a decoder adapted to receive the antenna address from the interface unit and generate a relay signal;

at least one sensor relay adapted to receive the relay signal from the decoder and to communicatingly connect a corresponding one of the at least one sensor to the interface unit; and at least one actuator relay adapted to receive the relay signal from the decoder and to provide power to a corresponding one of the at least one actuator.

2. The cell phone antenna system of claim 1, wherein the attitude of the antenna comprises at least one attitude selected from a set consisting of antenna tilt and antenna heading.

3. The cell phone antenna system of claim 1, wherein the attitude of the antenna comprises at least one antenna tilt and the at least one sensor comprises at least one tilt sensor.

4. The cell phone antenna system of claim 3, wherein:

the at least one antenna comprises at least two antennas;

the at least one tilt sensor comprises at least two tilt sensors;

the at least one sensor relay comprises at least two tilt sensor relays;

the at least one actuator comprises at least two tilt actuators; and the at least one actuator relay comprises at least two tilt actuator relays.

5. The cell phone antenna system of claim 4, wherein the at least one sensor comprises a level mechanically attached to each antenna for sensing the tilt of the antenna by sensing gravity.

6. The cell phone antenna system of claim 4, wherein the at least one sensor comprises a resolver mechanically attached to each antenna for sensing the tilt of the antenna by resolving the position of the antenna relative to a substantially fixed reference.

7. The cell phone antenna system of claim 4, wherein the at least two antennas are grouped into at least one sector, and the antenna system further includes a heading sensor for measuring the heading of the sector, and a heading actuator for changing the heading of the sector.

8. The cell phone antenna system of claim 4, further including a power source electrically connected to the at least two tilt actuator relays, wherein a Double Pole Double Throw (DPDT) relay is serially connected between the power source and the at least two tilt actuator relays.

9. The cell phone antenna system of claim 8, further including a power source electrically connected to the at least two tilt actuator relays, wherein the Double Pole Double throw (DPDT) relay and a Double Pole Single Throw (DPST) are serially connected between the power source and the at least two tilt actuator relays.

10. The cell phone antenna system of claim 1, wherein the interface unit provides data from one of the at least one sensor to the controller, and receives a command for one of the at least one actuator from the controller.

11. The cell phone antenna system of claim 10, wherein the interface unit is a multi interface processor adapted to interface with local and distant controllers.

12. The cell phone antenna system of claim 10, wherein the interface unit is a multi interface processor adapted to interface with a switching center serving as a distant controller.

13. The cell phone antenna system of claim 10, wherein the interface unit is a multi interface processor adapted to interface with a laptop computer serving as a local controller.

14. The cell phone antenna system of claim 1, wherein:

the attitude comprises an antenna heading;

the at least one sensor comprises a heading sensor; and the at least one actuator comprises a heading actuator.

15. A cell phone antenna monitoring system comprising:

antenna mounts;

at least two antennas mounted by the antenna mounts;

at least two tilt sensors adapted to measure a tilt of each of the at least two antennas;

an interface unit adapted to:

communicate with at least one controller; and generate an antenna address;

a decoder adapted to receive the antenna address from the interface unit and generate a tilt relay signal;

at least two tilt sensor relays adapted to receive the tilt relay signal from the decoder and to communicatingly connect a corresponding one of the at least two tilt sensors to the interface unit.

16. The cell phone antenna system of claim 15, wherein the at least two antennas are grouped into at least one sector, and the antenna system further includes a heading sensor for measuring the heading of the sector.

17. The cell phone antenna system of claim 15, further including:

a heading sensor; and a heading sensor relay electrically connected to the heading sensor, wherein the heading sensor relay switches between sending heading data from the heading sensor and tilt data from one of the at least two tilt sensor relays, to the interface unit.

18. A method for adjusting the attitude of cell phone antennas, the method comprising:

receiving an antenna ID at an interface unit;

converting the antenna ID to an antenna address;

sending the antenna address from the interface unit to a decoder;

decoding the antenna address and sending an ON Signal to a sensor relay corresponding to the antenna address;

sensing gravity with a tilt sensor to generate a sensor signal;

passing the sensor signal indicative of an antenna attitude through the switched-on sensor relay to the interface unit; and sending a message including the sensor signal from the interface unit to a controller.

19. The method of claim 18, wherein the passing a sensor signal through the selected sensor relay to the interface unit includes passing an azimuth signal.

20. The method of claim 18, further comprising:

receiving an actuator command at the interface unit, wherein the actuator command is from the controller;

sending an ON Signal to an actuator relay corresponding the second antenna address;

switching on the actuator relay receiving the ON Signal;

providing power through the switched-on actuator relay to change the attitude of the antenna corresponding to the second antenna ID.

* * * * *